US010639922B2

(12) United States Patent
Uetake et al.

(10) Patent No.: US 10,639,922 B2
(45) **Date of Patent: *May 5, 2020**

(54) INK-JET RECORDING APPARATUS

(71) Applicant: Konica Minolta, Inc., Chiyoda-ku, Tokyo (JP)

(72) Inventors: Shigeo Uetake, Higashiyamato (JP); Shigetaka Kurosu, Hino (JP); Atsuto Hirai, Ikoma (JP)

(73) Assignee: Konica Minolta, Inc., Chiyoda-ku, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/285,830

(22) Filed: Feb. 26, 2019

(65) Prior Publication Data

US 2019/0291492 A1 Sep. 26, 2019

(30) Foreign Application Priority Data

Mar. 26, 2018 (JP) ..... 2018-057685

(51) Int. Cl.
*B41M 5/20* (2006.01)
*B41J 11/00* (2006.01)

(52) U.S. Cl.
CPC ..... *B41M 5/20* (2013.01); *B41J 11/0015* (2013.01)

(58) Field of Classification Search
CPC ..... B41J 11/0015; B41M 5/20
See application file for complete search history.

(56) References Cited

FOREIGN PATENT DOCUMENTS

JP 2016010865 A 1/2016
JP 2017119407 A 7/2017

*Primary Examiner* — Lamson D Nguyen
(74) *Attorney, Agent, or Firm* — Buchanan Ingersoll & Rooney PC

(57) ABSTRACT

An ink-jet recording apparatus includes a first electrification adjuster and a second electrification adjuster. The first electrification adjuster disposed to face the recording material to be conveyed supplies a charge with one polarity. The second electrification adjuster disposed downstream the first electrification adjuster in the conveying direction to face the recording material supplies the charge with opposite polarity to that of the charge supplied by the first electrification adjuster so that the ink-jet image is formed at the downstream side of the electrification adjuster.

10 Claims, 8 Drawing Sheets

200
41
CONTROL UNIT
CPU
40
42
RAM
HEATER
23
43
ROM
FIRST DC POWER SUPPLY
271
44
STORAGE UNIT
SECOND DC POWER SUPPLY
281
HEAD UNIT
24
51
CONVEYANCE DRIVE UNIT
HEAD DRIVER
241
4
52
OPERATION DISPLAY UNIT
INK-JET HEAD
242
EXTERNAL APPARATUS
I/O INTERFACE
FIXING UNIT
25
53
IMAGE READER
26
54

FIG. 4
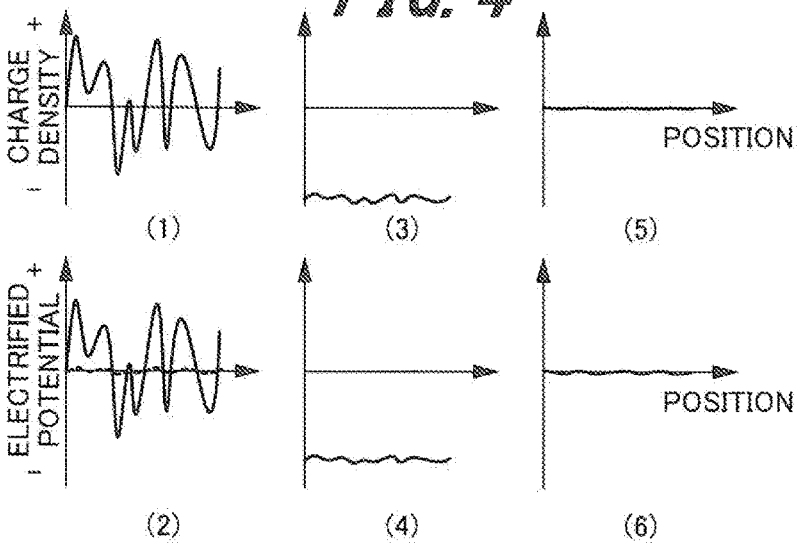
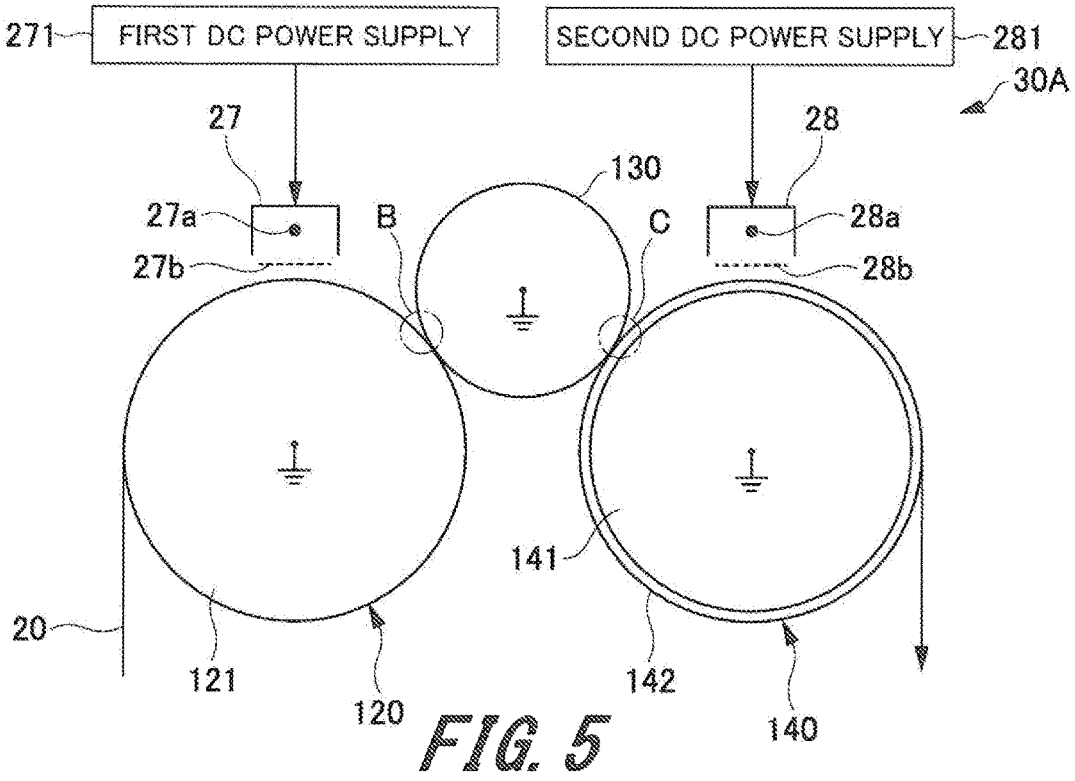
FIG. 5

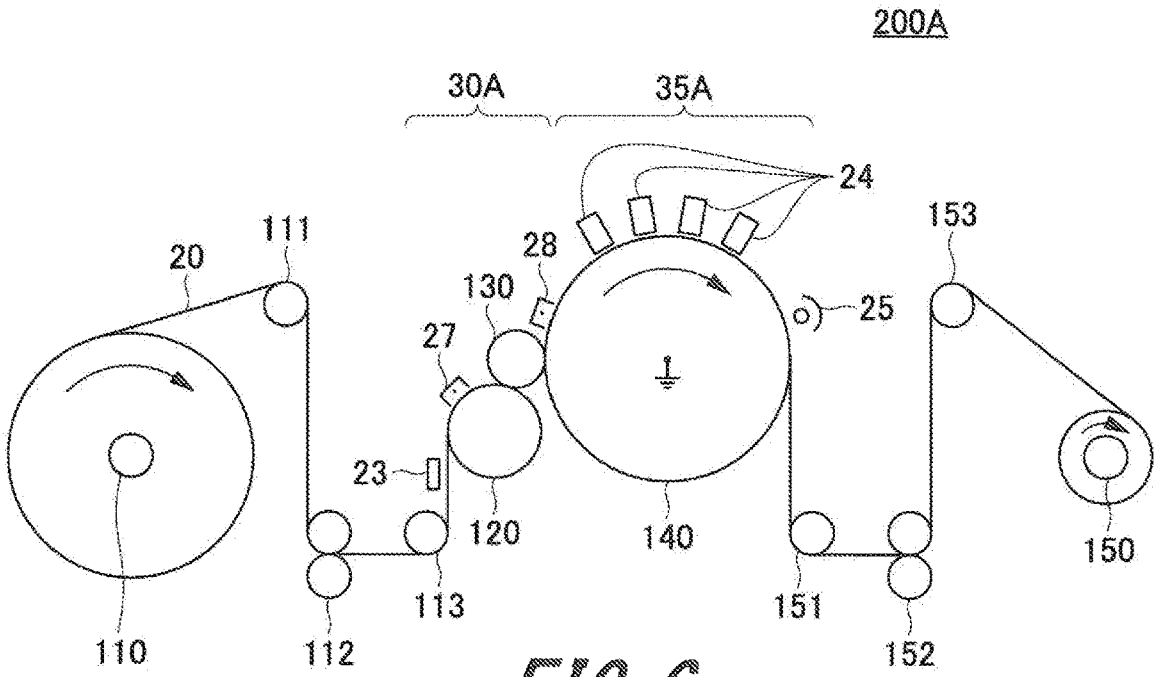
FIG. 6
FIG. 7
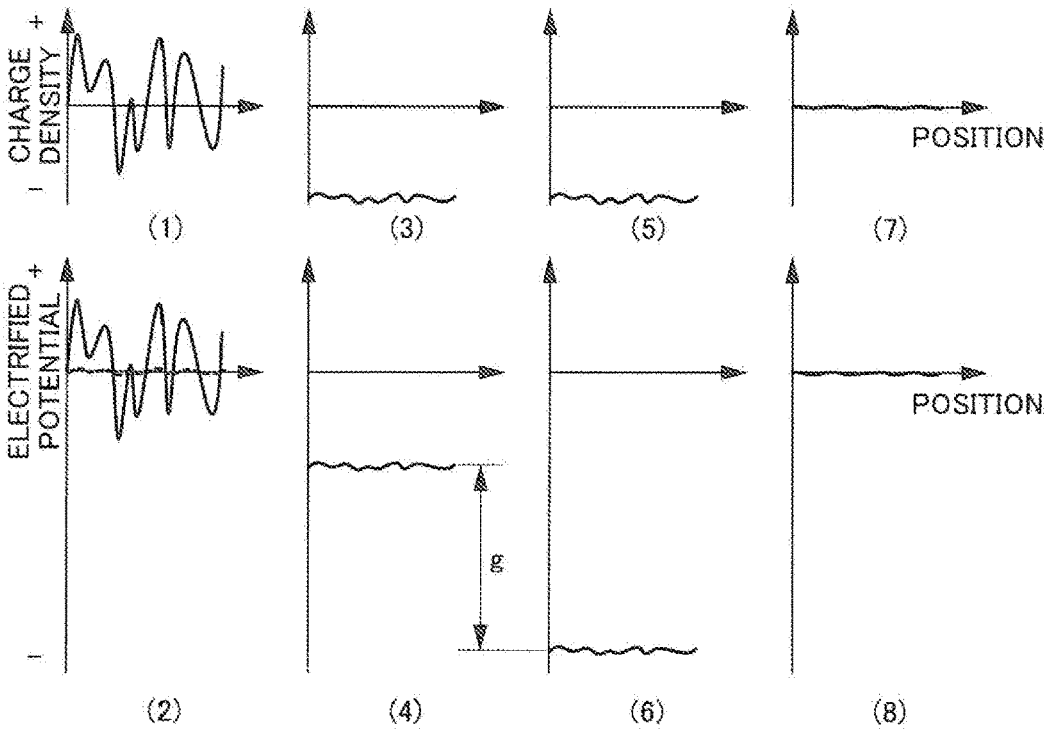

FIG. 10
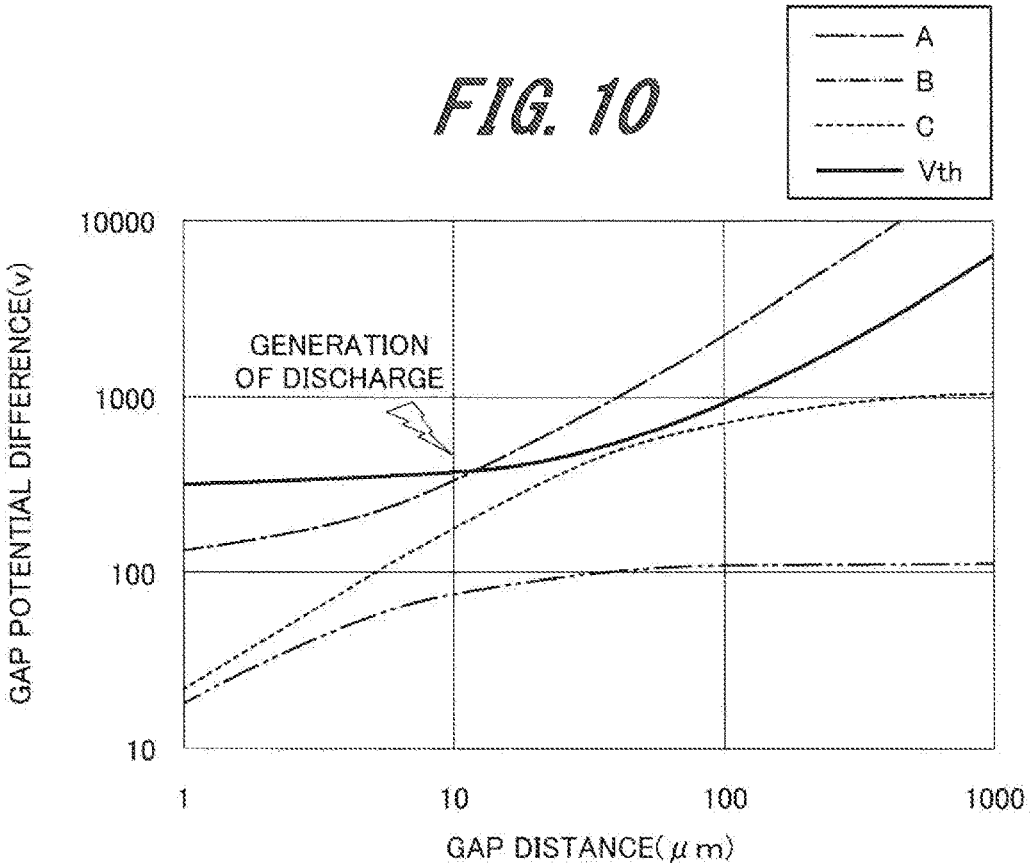
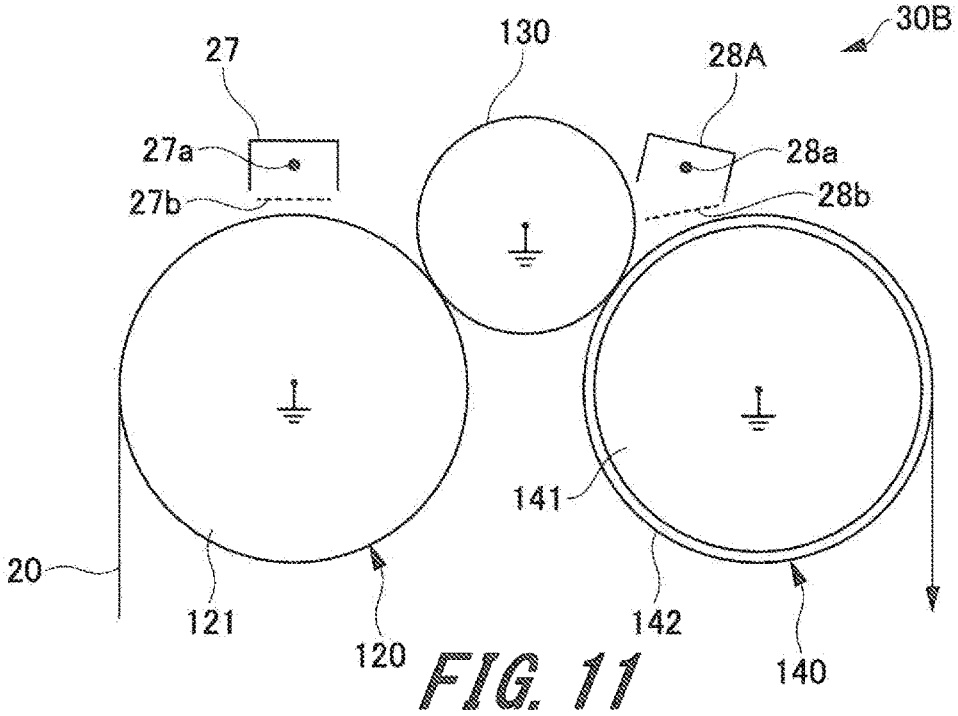
FIG. 11

FIG. 14

| | RECORDING MATERIAL | GRID VOLTAGE OF FIRST ELECTRIFICATION ADJUSTER | GRID VOLTAGE OF SECOND ELECTRIFICATION ADJUSTER | IMAGE NON-UNIFORMITY | STAIN OF HEAD |
|---|---|---|---|---|---|
| FIRST EXAMPLE | PET 12 μm | -50V | 0V | × | △ |
| | | -100V | | △ | △ |
| | | -150V | | ○ | △ |
| | OPP 30 μm | -300V | | ○ | △ |
| | | | -100V | ○ | ○ |
| SECOND EXAMPLE | PET 12 μm | -50V | 0V | × | △ |
| | | -100V | | ○ | △ |
| | | -150V | | × | △ |
| | OPP 30 μm | -300V | | ○ | △ |
| | | | -100V | ○ | ○ |
| THIRD EXAMPLE | PET 12 μm | -50V | 0V | × | △ |
| | | -100V | | ○ | △ |
| | | -150V | | ○ | △ |
| | OPP 30 μm | -300V | | ○ | △ |
| | | | -100V | ○ | ○ |
| FOURTH EXAMPLE | PET 12 μm | -50V | 0V | × | △ |
| | | -100V | | ○ | △ |
| | | -150V | | ○ | △ |
| | OPP 30 μm | -300V | | ○ | △ |
| | | | -100V | ○ | ○ |
| FIFTH EXAMPLE | PET 12 μm | -50V | 0V | × | △ |
| | | -100V | | ○ | △ |
| | | -150V | | ○ | △ |
| | OPP 30 μm | -300V | | ○ | △ |
| | | | -100V | ○ | ○ |
| FIRST COMPARATIVE EXAMPLE | PET 12 μm | -50V | 0V | × | △ |
| | | -100V | | × | △ |
| | | -150V | | × | △ |
| | OPP 30 μm | -300V | | × | △ |
| | | | -100V | × | △ |
| SECOND COMPARATIVE EXAMPLE | PET 12 μm | -50V | 0V | × | △ |
| | | -100V | | × | △ |
| | | -150V | | × | △ |
| | OPP 30 μm | -300V | | × | △ |
| | | | -100V | × | △ |

INK-JET RECORDING APPARATUS

CROSS-REFERENCE TO RELATED APPLICATIONS

The entire disclosure of Japanese Patent Application No. 2018-57685, filed on Mar. 26, 2018, is incorporated herein by reference in its entirety.

BACKGROUND ART

Technological Field

The present invention relates to an ink-jet recording apparatus.

Description of the Related Art

Charges on a sheet recording material (hereinafter referred to as a "recording material") with high insulation property such as a resin film and a synthetic paper are electrified by the frictional electrification, the separation discharge, and the corona discharge in the process of manufacturing the recording material, the surface treatment process such as the corona process, and the conveyance process, and remain on the surface without being attenuated. In most cases, those electrified charges are in the non-uniform state with uneven distribution on the recording material surface, for example, locally electrified with both positive and negative polarities. It has been known that the ink-jet (IJ) printing onto the above-described high insulating recording material generates an image noise owing to electrification of the recording material as described below.

When the recording material is electrified, the electric field formed between the electrified charge and the ink-jet head influences the flying characteristic of the ink droplet, thus changing the flying speed and the flying direction. This may cause the problem that the ink droplet reaches an unintended landing point on the recording material. Especially the small droplet is susceptible to the electric field because of large deceleration owing to air resistance. As a result, the following problems will occur. For example, the misted ink droplets (sub-droplets) are returned toward the ink-jet head side and adhering thereto under the influence of the electric field, and the ink droplets adhere to the unintended point on the recording material, resulting in scumming. The sub-droplet which has failed to reach the target landing position may be referred to as a satellite.

FIGS. 1A and 1B show a relationship between electrification of the recording material and the image noise in the ink-jet type image forming processing. FIG. 1A represents an example of the influence given to a flying ink droplet injected from an ink-jet head. FIG. 1B represents an example of the landed ink droplet.

FIG. 1A represents that the ink droplet injected from an ink-jet head 10 includes a main droplet 11 with a large volume, and a sub-droplet 11*a* (mist) generated in the process of generating the main droplet 11. Focusing on the sub-droplet 11*a* with high air resistance as shown in FIG. 1A, it is assumed that the sub-droplet 11*a* has a positive charge. A recording material 20 is positively electrified relatively uniformly. At the location where the vertical electric field is formed as shown in FIG. 1A, the sub-droplet 11*a* receives the electrostatic force directed toward the ink-jet head 10 in the direction opposite the flying direction (center part of FIG. 1A).

At the location where the horizontal electric field is formed by electrification non-uniformity of the recording material 20 (left side and right side of FIG. 1A), as a sub-droplet 12*a* becomes proximate to the surface of the recording material 20, it receives the lateral electrostatic force. The above-described electrostatic force changes the speed and direction of the ink droplet. As a result, the sub-droplet 12*a* reaches the different landing position from the originally intended position, resulting in the image noise. If the sub-droplet 11*a* is adhering to the ink-jet head 10 under the electrostatic force, the ink-jet head 10 will be stained. Especially when the sub-droplet 11*a* is adhering to the position near the nozzle, such malfunction as injection bending and the like will occur.

It has been known that the electrified charge on the recording material 20 or the like influences the ink droplets immediately after they reach the landing points. For example, as FIG. 1B shows, under the electric field in the planar direction as a result of electrification non-uniformity of the recording material 20, the electrostatic induction occurs in a landed ink droplet 13. The electrostatic force acts in the electric field direction, causing the problem of fluctuating the dot shape. The size of the dot shape fluctuation (deformation) may be affected depending on what extent the planar electric field is cancelled by movement of the electrostatically induced charge accompanied with the dot deformation. Therefore, it is necessary to reduce the non-uniformity in the charge density of the recording material 20 so as to suppress fluctuation of the dot shape. Especially when the recording material is thin, the electrostatic capacity between the recording material surface in the presence of the electrified charges, and the electrode at the back surface side of the recording material is large. Even if the electrified potential is relatively small, the charge density may be large. In order to suppress the dot shape fluctuation, it is important to reduce the charge density non-uniformity.

There has been known a destaticizer for destaticizing the recording material with a plurality of destaticizing units as described below. Japanese Unexamined Patent Application Publication No. 2017-119407 (Patent Literature 1) discloses the ink-jet recording apparatus which allows the ink-jet head to discharge droplets onto the insulating recording medium for recording, and includes a neutralizing unit for neutralizing electrification of the recording medium, a detector for detecting an electrification state of the recording medium, a control unit for controlling an amount of ions generated by the neutralizing unit based on the detection result, and a ground-connected conductive member in contact with the recording medium.

Japanese Unexamined Patent Application Publication No. 2016-010865 (Patent Literature 2) discloses the recording apparatus for recording by discharging ink droplets onto the recording surface of the recording medium. In reference to the electrification order, the material for forming the driven roller abutted on the recording surface of the recording medium while being conveyed on the conveying path is at the position closer to the polarity opposite to the polarity of electrified mist generated accompanied with the ink droplet discharge than the material for forming the member that constitutes the recording surface.

CITATION LIST

Patent Literature

Patent Literature 1: Japanese Unexamined Patent Application Publication No. 2017-119407

Patent Literature 2: Japanese Unexamined Patent Application Publication No. 2016-010865

SUMMARY

Patent Literature 1 discloses the ionizer configured to neutralize electrification. The electrostatic force cannot act on charges generated by the ionizer owing to the closed electric line of force at the non-uniform electrified part of the film. This makes it difficult to supply charges in accordance with the electrification non-uniformity (failing to sufficiently eliminate the electrification non-uniformity).

In Patent Literature 2, the film is triboelectrified, and accordingly, it is difficult to achieve the uniform electrification and to control the electrified amount.

It is preferable to have no electrification non-uniformity on the recording material surface (electrified potential non-uniformity, charge density non-uniformity) in another image forming processing such as electrographic type for the purpose of maintaining the image quality.

It is an object of the present invention to eliminate the electrification non-uniformity on the recording material surface as a factor that affects the image quality, and to suppress unnecessary influence of the electric field.

To achieve the above-described object, according to an aspect of the present invention, the ink-jet recording apparatus reflecting one aspect of the present invention includes an electrification adjustment apparatus for adjusting electrification of a recording material to be conveyed, and an image forming unit for forming an image on the recording material which has been subjected to an electrification adjustment through ink-jet processing. The electrification adjustment apparatus includes a conveyor member for conveying the recording material, a first electrification adjuster disposed to face the recording material to be conveyed, which supplies a charge with one polarity, a second electrification adjuster disposed at a downstream side of the first electrification adjuster in a conveying direction while facing the recording material, which supplies a charge with opposite polarity to the one polarity of the charge supplied by the first electrification adjuster, a first DC power supply for DC power supply to the first electrification adjuster, and a second DC power supply for DC power supply to the second electrification adjuster, which has a polarity opposite to the polarity of the first DC power supply.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention:

FIG. 4 shows graphs each representing an example of an electrified charge and an electrified potential at each position on each part of the electrification adjustment apparatus according to the first embodiment of the present invention;

FIG. 5 is an explanatory view showing an example of an electrification adjustment apparatus according to a second embodiment of the present invention;

FIG. 6 is an explanatory view showing a structure example of an ink-jet recording apparatus provided with the electrification adjustment apparatus as shown in FIG. 5 according to the second embodiment of the present invention;

FIG. 7 shows graphs each representing an example of an electrified charge and an electrified potential at each position on each part of the electrification adjustment apparatus according to the second embodiment of the present invention;

FIG. 10 is a graph indicating a result of calculating a gap potential difference with respect to a gap distance between the guide member and the recording material according to the second embodiment of the present invention;

FIG. 11 is an explanatory view showing an example of an electrification adjustment apparatus according to a third embodiment of the present invention;

FIG. 14 is a table showing measurement results derived from the first to the fifth examples, and the first and the second comparative examples.

DETAILED DESCRIPTION OF EMBODIMENTS

Hereinafter, an example of one or more modes for carrying out the present invention (hereinafter referred to as "embodiments") will be described referring to the attached drawings. However, the scope of the invention is not limited to the disclosed embodiments. In the specification and the drawings, components with substantially the same functions or the same structures will be designated with the same codes, and explanations thereof, thus will be omitted.

First Embodiment

Structures of Electrification Adjustment Apparatus and Ink-Jet Recording Apparatus Each structure example of an electrification adjustment apparatus according to a first embodiment of the present invention, and an ink-jet recording apparatus provided with the electrification adjustment apparatus will be described.

Figure 2:
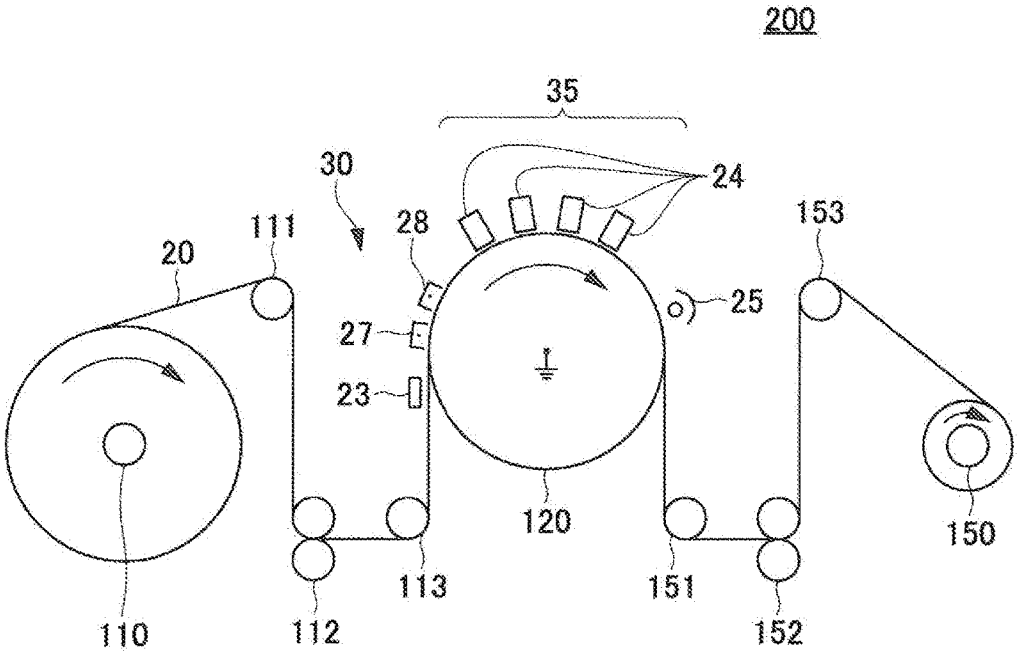
FIG. 2 is an explanatory view showing a structure example of an ink-jet recording apparatus provided with an electrification adjustment apparatus according to a first embodiment of the present invention.

FIG. 2 is an explanatory view showing a structure example of an ink-jet recording apparatus 200 provided with an electrification adjustment apparatus 30 according to the first embodiment. The ink-jet recording apparatus 200 as shown in FIG. 2 is an example of an image forming apparatus to which the present invention is applied.

As FIG. 2 shows, the ink-jet recording apparatus 200 includes a feed roll 110 on which a recording material 20 is wound, the electrification adjustment apparatus 30, an image forming unit 35 including four head units 24 corresponding to the respective basic colors, and a winding roll 150 for winding the recording material 20 on which the image has been formed. The ink-jet recording apparatus 200 includes a conveyor mechanism constituted by a conveyor roller and a driven roller for conveying the recording material 20 fed from the feed roll 110 to the winding roll 150 via the electrification adjustment apparatus 30 and the image forming unit 35. Referring to the example shown in FIG. 2, a driven roller 111, a conveyor roller pair 112, and a driven roller 113 are disposed between the feed roll 110 and the electrification adjustment apparatus 30 (first guide member 120). A driven roller 151, a conveyor roller pair 152, and a driven roller 153 are disposed between the image forming unit 35 (first guide member 120) and the winding roll 150.

The electrification adjustment apparatus 30 is disposed at the upstream side of the head unit 24 on the conveying path of the ink-jet recording apparatus 200, and configured to adjust an electrification state of the insulating recording material 20 subjected to the electrification adjustment. The electrification adjustment apparatus 30 uniformizes the electrification non-uniformity on the recording material 20, having its image forming surface on which an image is formed in the ink-jet processing executed by the image forming unit 35 disposed at the downstream side. Specifically, the image is formed on the recording material 20 by means of ink-jet heads 242 (see FIG. 3) each provided with ultraviolet-curable type ink (hereinafter simply referred to as "ink") corresponding to yellow (Y), magenta (M), cyan (C), and black (K), respectively. The ink is cured by a light source for UV irradiation (UV lamp) of a fixing unit 25 at the downstream side, providing the fixed image.

Electrification Adjustment Apparatus

The electrification adjustment apparatus 30 will be described in further detail. The electrification adjustment apparatus 30 includes a first guide member 120, a first electrification adjuster 27, a second electrification adjuster 28, a first DC power supply 271 (see FIG. 3), and a second DC power supply 281 (see FIG. 3).

The first guide member 120 is structured to have a surface in contact with the conveyed recording material 20. The first guide member 120 as an example of the conveyor member is constituted by a rotary body such as a roller having a rotary axis perpendicular to the conveying direction. The recording material 20 subjected to the electrification adjustment is conveyed while being wound on the first guide member 120. The first guide member 120 is formed as a metal roller 121 (example of a conductive roller with low resistance) made of aluminum, for example, and grounded. The metal roller 121 is exemplified as an electrode constituted from the conveyor member either partially or entirely.

The first electrification adjuster 27 is disposed to face a surface of the first guide member 120, which is in contact with the recording material 20. Upon reception of the DC voltage applied from the first DC power supply 271 (see FIGS. 3 and 5), the first electrification adjuster 27 generates a charge with one polarity so as to be supplied to the first guide member 120. The electric field is formed between the voltage applied to the first electrification adjuster 27 and the grounded first guide member 120 so that the charge is supplied to the recording material 20 wound on the surface of the first guide member 120.

The second electrification adjuster 28 is disposed to face the surface of the first guide member 120, which is in contact with the recording material 20. Upon reception of the DC voltage applied from the second DC power supply 281 (see FIG. 3), the second electrification adjuster 28 generates a charge with opposite polarity to that of the charge supplied by the first electrification adjuster 27 so that the generated charge with the opposite polarity is supplied to the first guide member 120. The electric field is generated between the voltage applied to the second electrification adjuster 28 and the grounded first guide member 120 so that the charge with the opposite polarity is supplied to the recording material 20 wound on the surface of the first guide member 120.

The first DC power supply 271 is a power supply circuit for supplying DC voltage (first DC power supply) to the first electrification adjuster 27. The second DC power supply 281 is a power supply circuit for supplying DC voltage (second DC power supply) with opposite polarity to that of the first DC power supply 271 to the second electrification adjuster 28.

A corona electrifier and a roller electrifier may be employed for the first electrification adjuster 27 and the second electrification adjuster 28. The present embodiment is configured to employ a scorotron electrifier (a kind of the corona electrifier) having a grid electrode 27*b* (28*b*) disposed between a wire-like corona discharge electrode 27*a* (28*b*) extending in a main scanning direction as shown in FIG. 5, and an electrification body (the recording material 20 in the present embodiment). The scorotron electrifier adjusts the charge amount to be supplied to the recording material 20 via the grid electrode 27*b* utilizing the voltage to be applied to the grid electrode 27*b*. Specifically, it is possible to provide two separate functions, that is, the function for generating charges by the corona discharge electrode 27*a* (28*a*), and the function for forming the electric field by the grid electrode 27*b* (28*b*) so as to secure the charge supply amount in accordance with the electrostatic capacity of the recording material 20. The scorotron electrifier allows the grid electrode 27*b* (28*b*) for forming the electric field to be disposed adjacent to the recording material 20. Accordingly, it is preferable to employ the scorotron electrifier in terms of uniformizing the electrification non-uniformity, and adjusting the electrified amount.

In the present embodiment, the recording material 20 subjected to the electrification adjustment is assumed to be a resin film, and the recording material with electrically high resistance. The synthetic paper and the coated paper may be the high resistance paper. In the case of low humidity, the resistance of the paper becomes higher than that of the paper at the normal humidity. The above-described paper may also be the one to be subjected to the electrification adjustment.

In the present embodiment, the ink-jet recording apparatus 200 using the ultraviolet-curable type ink has been described as an example. However, the image forming method is not limited to the one as described above. It is possible to use the aqueous ink, the solvent-base ink and the like for forming images. A variety of colors, or arbitrary number of colors may be used for forming the image without being limited to those described above.

Control System for Ink-Jet Recording Apparatus

Figure 3:
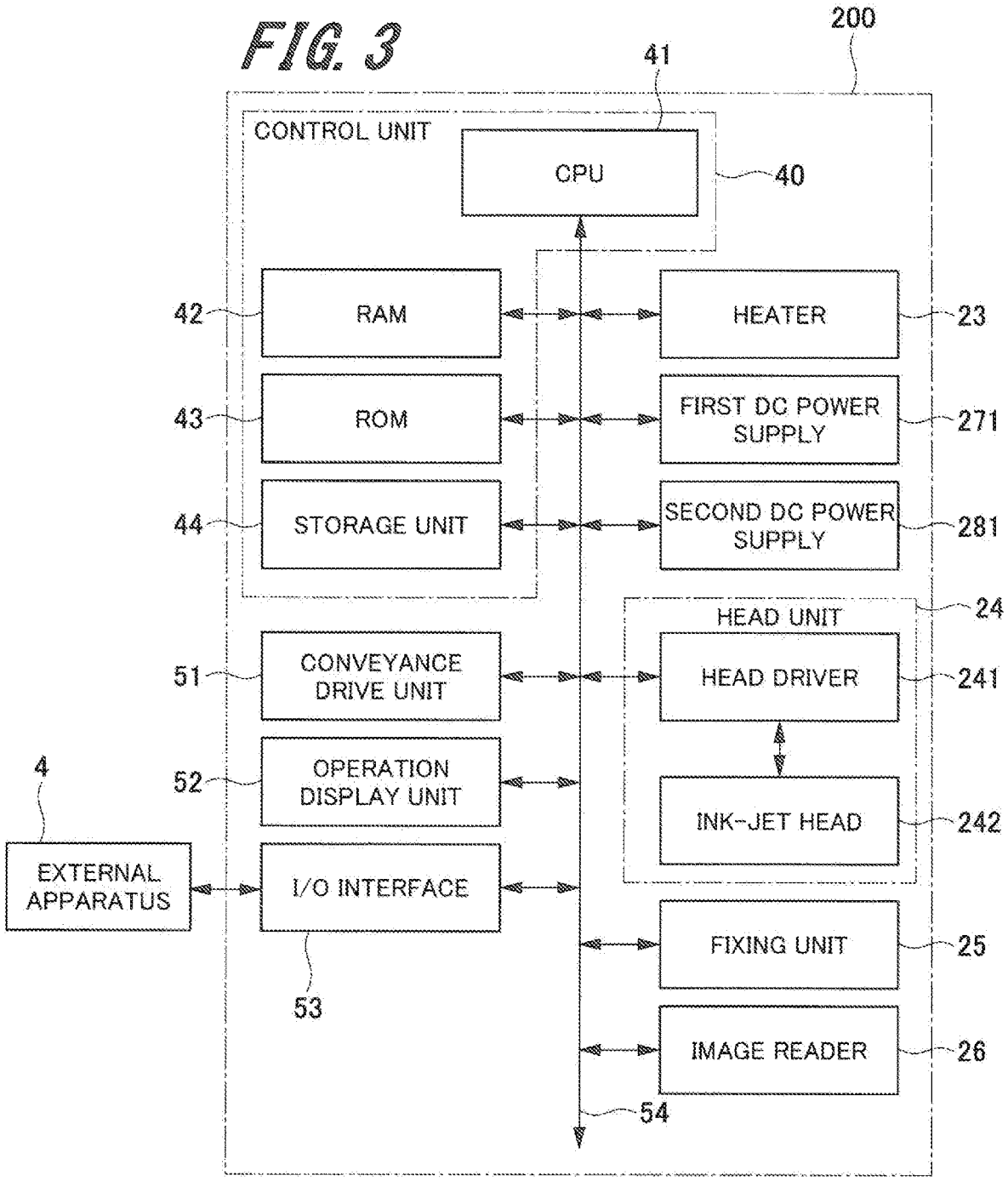
FIG. 3 is a block diagram showing an example of a control system for the ink-jet recording apparatus as shown in FIG. 2 according to the first embodiment of the present invention.

The structure of the control system for the ink-jet recording apparatus 200 will be described referring to FIG. 3. FIG. 3 is a block diagram showing a structure example of the control system for the ink-jet recording apparatus 200.

As FIG. 3 shows, the ink-jet recording apparatus 200 includes a control unit 40. The control unit 40 includes a CPU (Central Processing Unit) 41, a RAM (Random Access Memory) 42 used as a work area for the CPU 41, and a ROM (Read Only Memory) 43 for storing the program and the like to be executed by the CPU 41, for example. The control unit 40 further includes a storage unit 44 as a mass storage device such as a hard disk drive (HDD). The storage unit 44 stores image data read by an image reader 26, the information for executing the electrification adjustment, the test chart for detecting the discharge fault of the nozzle of an ink-jet head 242, and the information for executing the detection operation with respect to the discharge fault of the nozzle.

The ink-jet recording apparatus 200 includes a conveyance drive unit 51 for driving the conveyor system, for example, a not shown image forming drum, a paper ejection unit, a paper reversing unit and the like, an operation display unit 52, and an I/O interface 53.

The CPU 41 of the control unit 40 is connected to a heater 23, the head units 24, the fixing unit 25, the image reader 26, the RAM 42, the ROM 43, and the storage unit 44 via a system bus 54 so as to control the entire apparatus. The CPU 41 is connected to the conveyance drive unit 51, the operation display unit 52, and the I/O interface 53 via the system bus 54.

The operation display unit 52 is a touch panel constituted as a display, for example, a liquid crystal display (LCD) or an organic ELD (Electro Luminescence Display). The operation display unit 52 displays an instruction menu for the user, and information relating to the nozzle discharge detection operation, and the acquired image data. Furthermore, the operation display unit 52 includes a plurality of keys functioning as an input unit for receiving inputs of data such as various instructions, characters, and figures through the user's key operation.

The I/O interface 53 is communicably connected to an external apparatus 4. The I/O interface 53 receives a print job (image data, output setting) from the external apparatus 4. The I/O interface 53 outputs the received image data to the control unit 40. The control unit 40 subjects the image data received from the I/O interface 53 to image processing. The control unit 40 may be configured to execute the image processing to the received image data as needed, for example, the shading correction, the image density adjustment, and the image compression.

The head unit 24 receives the image data which have been subjected to the image processing executed by the control unit 40 so as to form a predetermined image on the recording material 20 based on the image data. Specifically, the head unit 24 drives a head driver 241 to allow the ink-jet head 242 to discharge the ink to the predetermined position. The heater 23 for heat generation is disposed at the upstream side of the head unit 24 so that the recording material 20 passing therearound has the predetermined temperature under the control of the control unit 40.

The four head units 24 are disposed corresponding to colors of yellow (Y), magenta (M), cyan (C), and black (K), respectively. The four head units 24 corresponding to yellow, magenta, cyan, black are arranged sequentially in the above-described color order from the upstream side in the direction for conveying the recording material 20.

The head unit 24 is set to have a length (width) sufficient to entirely cover the recording material 20 in the direction orthogonal to the one for conveying the recording material 20 (main scanning direction). In other words, the ink-jet recording apparatus 200 is of line head type as a one-pass system. Each of the four head units 24 has the same structure except the color of the ink to be discharged.

In the present embodiment, prior to the image formation by the head units 24 onto the recording material 20, the control unit 40 controls the first DC power supply 271 and the second DC power supply 281 so that charges supplied from the first electrification adjuster 27 and the second electrification adjuster 28 are regulated to adjust electrification of the recording material 20 (see FIG. 2). Based on the information relating to the variety of the recording material 20 (for example, the information about resistance, specific dielectric constant, and thickness), and image forming conditions (for example, density of image, and printing area rate), the control unit 40 adjusts the amount of charges supplied from the first electrification adjuster 27 and the second electrification adjuster 28.

The image formed on the recording material 20 by the head units 24 is read by the image reader 26. The read image data are transmitted to the control unit 40. Upon detection of the nozzle discharge fault, the control unit 40 identifies the nozzle having the discharge fault based on the image data transmitted from the image reader 26. The control unit 40 executes the correction process to the head unit 24 by increasing the discharge amount of the ink from the nozzle adjacent to the one having the discharge fault.

Electrification Adjustment Operation

An electrification adjustment operation performed by the electrification adjustment apparatus 30 (the process for uniformly destaticizing the non-uniform electrification state) will be described referring to FIG. 4. Each of graphs (1) to (6) represents an example of the electrified charge and the electrified potential at each position on the recording material 20 located at the respective parts of the electrification adjustment apparatus 30. Each x-axis of the graphs (1) to (6) shown in FIG. 4 represents the position on the recording material 20, each y-axis shown in FIG. 4 (corresponding to odd numbers) represents the charge density, and each y-axis shown in FIG. 4 (corresponding to even numbers) represents the electrified potential.

Figure 1A:
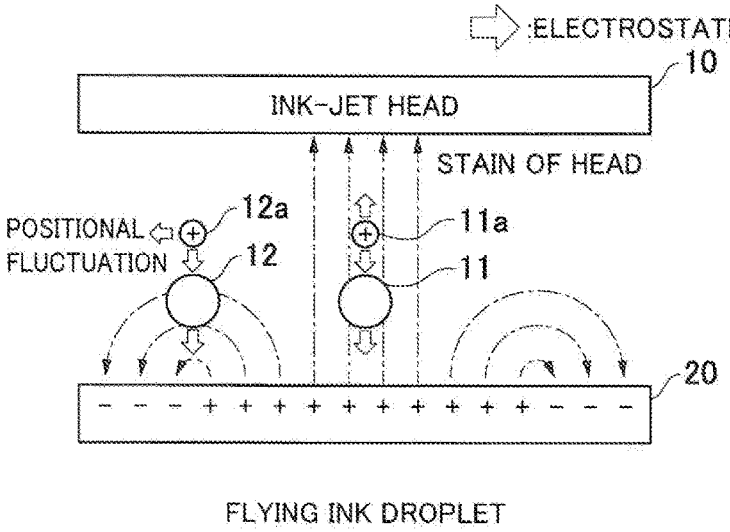
FIGS. 1A and 1B are explanatory views representing a relationship between electrification of a recording material and an image noise in ink-jet type image forming processing.
Figure 1B:
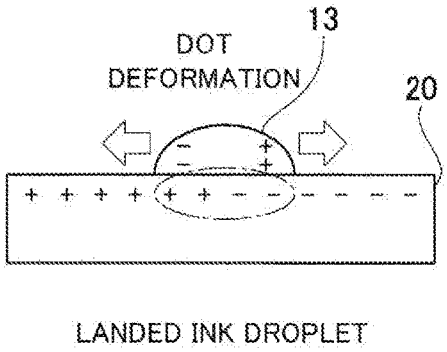

As the graph (1) of FIG. 4 shows, in the presence of electrified charges with non-uniformity on the surface of the insulating recording material 20, the electrified potential in accordance with the charge density non-uniformity is formed on the surface around the region as described above (solid line in the graph (2) of FIG. 4). However, as the left and right sides of FIG. 1A show, the charges with opposite polarities around the surface of the recording material 20 may close the electric line of force. Therefore, as the distance from the surface becomes farther, the electrified potential affected by the charge density non-uniformity is averaged (see broken line of the graph (2) of FIG. 4). The ion generator (electrifier) generally employed for destaticizing purpose allows suction of the generated charges at the electrified potential formed by the electrified charges (see broken line of the graph (2) of FIG. 4). Upon neutralization of the electrified charges through averaging, the electrostatic force directed to the recording material 20 does not act on the charge with either polarity, thus failing to sufficiently destaticize the non-uniform electrification on the surface of the recording material 20 as described above.

The first electrification adjuster 27 is configured to generate the charge with one polarity (negative charge in this case), and form the electric field that ensures sufficient supply of charges generated between the first electrification adjuster 27 and the first guide member 120 so that the recording material 20 is entirely electrified with the one polarity. This makes it possible to supply the charge to the region with the closed electric line of force on the surface of the recording material 20 (see FIG. 1A). As a result, the charge moves along the electric line of force in accordance with the electrification non-uniformity, thus reducing the electrification non-uniformity (see graphs (3), (4) of FIG. 4). In the above-described case, preferably, the first electrification adjuster 27 supplies sufficient charge amount compared with the one which causes the electrification non-uniformity on the surface of the recording material 20 (electrification with one polarity).

The second electrification adjuster 28 supplies appropriate amount of charges each with opposite polarity to that of the charge supplied by the first electrification adjuster 27 by utilizing the potential electrified by the first electrification adjuster 27 as shown in the graph (4) of FIG. 4 so that the electrification amount of the recording material 20 reaches the required level (level zero in this case). The second electrification adjuster 28 adjusts the electrified potential of the recording material 20 conveyed on the first guide member 120 to be approximated to 0 V (see graph (6) of FIG. 4). This makes it possible to approximate the charge amount electrified on the recording material 20 to the target value (preferably, zero) (see graph (5) of FIG. 4).

The above-described first embodiment employs the first electrification adjuster 27 disposed while facing the first guide member 120, and the second electrification adjuster 28 disposed at the downstream side of the first electrification adjuster 27, and allows the control unit 40 to control the first DC power supply 271 and the second DC power supply 281 so that the charge supplied by the first electrification adjuster 27 has the polarity opposite to the polarity of the charge supplied by the second electrification adjuster 28. The control unit 40 is capable of approximating the amount of charge for electrifying the recording material 20 to the target charge amount (preferably, zero) by allowing the second electrification adjuster 28 to bring the electrified potential of the recording material 20 conveyed on the first guide member 120 into approximate value of 0 V. This makes it possible to eliminate the electrification non-uniformity on the surface of the recording material 20, thus suppressing the unnecessary influence of the electric field.

Second Embodiment

In the case of an extremely thin film (for example, thickness of 30 μm or thinner) used for the insulating recording material 20, the potential generated by the electrified charge on the film surface is low because of large electrostatic capacity of the film. A fine adjustment of the charge amount, therefore, is difficult in spite of using the electrification adjustment apparatus 30 according to the first embodiment. Then the first guide member 120 (first counter member) facing the first electrification adjuster 27, and the second guide member 140 (second counter member) facing the second electrification adjuster 28 are disposed as shown in FIG. 5, and the capacitive component (an insulation layer 142) is formed on the surface of the second guide member 140. This may make the potential generated by the electrified charge high, resulting in easy fine adjustment of the electrification amount.

A structure example of an electrification adjustment apparatus according to the second embodiment is described below. FIG. 5 is an explanatory view showing an example of the electrification adjustment apparatus according to the second embodiment.

An electrification adjustment apparatus 30A as shown in FIG. 5 includes the first guide member 120, the second guide member 140, an intermediate guide member 130, the first electrification adjuster 27, the second electrification adjuster 28, the first DC power supply 271, and the second DC power supply 281.

Each of the first guide member 120, the second guide member 140, and the intermediate guide member 130 is structured to have a surface in contact with the conveyed recording material 20. The second guide member 140 is disposed at the downstream side of the first guide member 120 in the conveying direction. The intermediate guide member 130 is disposed between the first guide member 120 and the second guide member 140 so as to be in abutment with both members via the recording material 20. Each of the first guide member 120, the second guide member 140, and the intermediate guide member 130 as an example of the conveyor member is constituted by a rotary body such as a roller having a rotary axis perpendicular to the conveying direction.

The second guide member 140 is formed as a metal roller 141 made of aluminum having its surface coated with the insulation layer 142, and grounded. The metal roller 141 is exemplified as the electrode constituted from the conveyor member either partially or entirely. The insulation layer 142 is made of an insulating resin, for example.

The insulating recording material 20 subjected to the electrification adjustment is conveyed while being wound on the respective surfaces of the first guide member 120, the intermediate guide member 130, and the second guide member 140 sequentially. The intermediate guide member 130 regulates the conveying path for the recording material 20 kept in a tensed state.

The first electrification adjuster 27 is disposed to face the surface of the first guide member 120. As the recording material 20 is conveyed to the first guide member 120, the first electrification adjuster 27 is positioned to face the surface of the recording material 20, which is not in contact with the first guide member 120. Upon reception of the DC voltage applied from the first DC power supply 271, the first electrification adjuster 27 generates the charge with one polarity so as to be supplied to the first guide member 120. The electric field is formed between the voltage applied to the first electrification adjuster 27 and the grounded first guide member 120 so that the charge is supplied to the recording material 20 which is wound on the surface of the first guide member 120.

The second electrification adjuster 28 is disposed to face the surface of the second guide member 140. As the recording material 20 is conveyed to the second guide member 140, the second electrification adjuster 28 is positioned to face the surface of the recording material 20, which is not in contact with the second guide member 140. Upon reception of the DC voltage applied from the second DC power supply 281, the second electrification adjuster 28 generates the charge with opposite polarity to that of the charge supplied form the first electrification adjuster 27 so that the generated charge with the opposite polarity is supplied to the second guide member 140. The electric field is generated between the potential of the second electrification adjuster 28 in accordance with the applied DC voltage and the electrified charge of the recording material 20 on the grounded second guide member 140 so that the charge with the opposite polarity is supplied to the recording material 20 wound on the surface (insulation layer 142) of the second guide member 140.

The intermediate guide member 130 is a conductive roller (for example, the metal roller) disposed in abutment with both the first guide member 120 and the second guide member 140. It is preferable to form the intermediate guide member 130 as the roller with the surface onto which an elastic member is applied for securing the contact with both the first guide member 120 and the second guide member 140. As the intermediate guide member 130 is interposed between the first guide member 120 and the second guide member 140, the recording material 20 electrified by the first electrification adjuster 27 is conveyed to the second electrification adjuster 28 while having its surface either front or back surface constantly kept in contact with any one of the first guide member 120, the intermediate guide member 130, and the second guide member 140.

Each of the first guide member 120, the second guide member 140, and the intermediate guide member 130 may be formed as the fixed member instead of the rotatable roller. The use of the roller may suppress wear on the surface of the recording material 20.

Structure of Ink-Jet Recording Apparatus

FIG. 6 is an explanatory view showing a structure example of an ink-jet recording apparatus with the electrification adjustment apparatus 30A as shown in FIG. 5. An ink-jet recording apparatus 200A as shown in FIG. 6 is an example of the image forming apparatus to which the present invention is applied.

The ink-jet recording apparatus 200A according to the present embodiment as shown in FIG. 6 is configured to have the structure of the ink-jet recording apparatus 200 (see FIG. 2) derived from replacing the electrification adjustment apparatus 30 and the image forming unit 35 with the electrification adjustment apparatus 30A and an image forming unit 35A. The ink-jet recording apparatus 200A conveys the recording material 20 fed from the feed roll 110 to the winding roll 150 via the electrification adjustment apparatus 30A and the image forming unit 35A. Referring to an example shown in FIG. 6, the driven roller 111, the conveyor roller pair 112, and the driven roller 113 are disposed between the feed roll 110 and the electrification adjustment apparatus 30A (first guide member 120). The driven roller 151, the conveyor roller pair 152, and the driven roller 153 are disposed between the image forming unit 35A (second guide member 140) and the winding roll 150.

The electrification non-uniformity on the recording material 20 is uniformized by the electrification adjustment apparatus 30A, and an image is formed on the image forming surface of the recording material by the image forming unit 35A downstream from the electrification adjustment apparatus 30A through the ink-jet processing. The insulation layer 142 formed on the surface of the second guide member 140 functions as a heat insulation layer for suppressing fluctuation in the temperature of the second guide member 140 owing to the heat generated upon UV curing in the fixing unit 25.

It is possible to form a predetermined electric field between the ink-jet head 242 and the recording material 20 through adjustment of the electrified potential of the recording material 20 performed by the second electrification adjuster 28 in accordance with the electrification characteristic (electrified polarity) of the ink droplet. In the case that the second electrification adjuster 28 electrifies the recording material 20 to the predetermined electrified potential, the image may be formed on the second guide member 140 which faces the second electrification adjuster 28 so as to form the required electric field at the electrification potential adjusted by the second electrification adjuster 28 without fluctuating the electrostatic capacity that varies the electrified potential of the recording material 20.

Especially in the case that the electrified potential of the recording material 20 is controlled on the first guide member 120 as the conductor likewise the ink-jet recording apparatus 200 (see FIG. 2) according to the first embodiment, the charge amount required to achieve the target electrified potential becomes large, thus causing the risk of separation discharge. It is therefore preferable to form images through the ink-jet processing on the guide member where the electrification adjustment has been executed to the recording material 20. The image forming processing is executed on the same guide member until the UV curing so as to suppress disturbance of the image even if the separation discharge occurs after forming the image. It is possible to execute the image formation under the appropriate control of the electric field between the ink-jet head 242 and the recording material 20.

Electrification Adjustment Operation

An electrification adjustment operation performed by the electrification adjustment apparatus 30 (the process for uniformly destaticizing the non-uniform electrification state) will be described referring to FIG. 7. Each of graphs (1) to (8) shown in FIG. 7 represents an example of the electrified charge and the electrified potential at each position on the recording material 20 located at the respective parts of the electrification adjustment apparatus 30. Each x-axis of the graphs (1) to (8) shown in FIG. 7 represents the position on the recording material 20, each y-axis shown in FIG. 7 (corresponding to odd numbers) represents the charge density, and each y-axis shown in FIG. 7 (corresponding to even numbers) represents the electrified potential. The graphs (1) to (4) shown in FIG. 7 are the same as those shown in FIG. 4, and explanations thereof, thus will be omitted.

Increase in the electrostatic capacity of the recording material 20 to be electrified may reduce the extent of increase in the electrified potential by the supplied charge so as to reduce the electric field formed by the first electrification adjuster 27 (possible to supply sufficient charge at low voltage). It is preferable to maximize the electrostatic capacity on the surface of the first guide member 120 by employing the conductive roller as the first guide member 120 having its surface in contact with the recording material 20 (on the back surface of the recording material 20). In the present embodiment, the metal roller is used for the first guide member 120.

Figure 8:
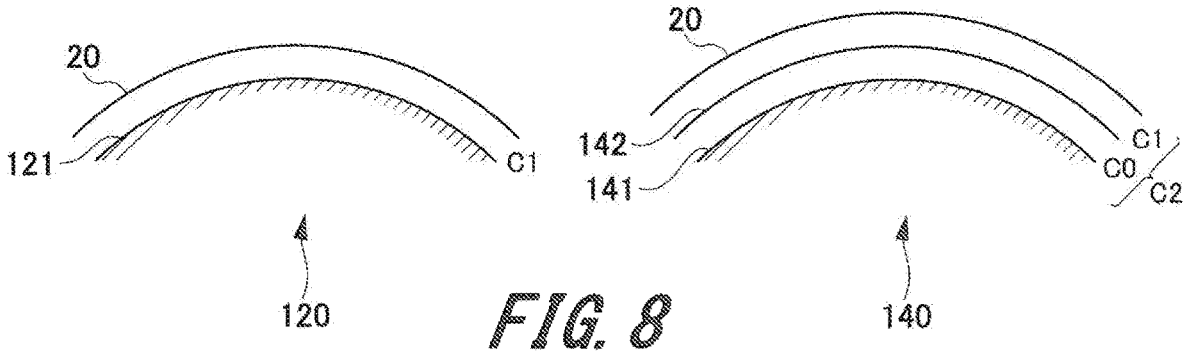
FIG. 8 is an explanatory view representing an electrostatic capacity on the surface of each guide member according to the first embodiment of the present invention.

The second guide member 140 has its surface applied with the insulation layer 142, on which the recording material 20 is superposed. As FIG. 8 shows, in the region covered by the second electrification adjuster 28, a synthetic electrostatic capacity C2 of an electrostatic capacity C1 of the recording material 20 and an electrostatic capacity C0 of the insulation layer 142 (the electrostatic capacity on the surface of the second guide member 140) is smaller than the electrostatic capacity in the region covered by the first electrification adjuster 27. The region covered by the first electrification adjuster 27 refers to the range influenced by the charge generated by the first electrification adjuster 27 (electrification adjustable area). The region covered by the second electrification adjuster 28 may also be defined correspondingly. The electrified potential of the second electrification adjuster 28 becomes higher than the one derived from the charge (see graph (5) of FIG. 7) electrified by the first electrification adjuster 27 by the amount corresponding to a potential difference g (see graph (6) of FIG. 7). As described above, in the region covered by the second electrification adjuster 28, the electrostatic capacity is small, and the electrified potential largely changes relative to the electrified charge amount.

The second electrification adjuster 28 supplies appropriate amount of charges each with opposite polarity to that of the charge supplied by the first electrification adjuster 27 by utilizing the electrified potential as shown in the graph (6) of FIG. 7 so that the electrified amount of the recording material 20 reaches the required level (level zero in the embodiment). The second electrification adjuster 28 adjusts the electrified potential of the recording material 20 conveyed on the second guide member 140 to be approximated to 0V (see graph (8) of FIG. 7). This makes it possible to approximate the charge amount electrified on the recording material 20 to the target value (preferably, 0) (see graph (7) of FIG. 7).

For uniformization of the electrification non-uniformity as described above, the first electrification adjuster 27 supplies sufficient amount of charges to the region with electrification non-uniformity of the recording material 20 for electrification with one polarity (by increasing the electrostatic capacity of the first electrification adjuster 27), and the second electrification adjuster 28 with less electrostatic capacity adjusts the charge amount on the surface of the recording material 20. It is preferable to provide the intermediate guide member 130 in contact with both the first guide member 120 and the second guide member 140 so as not to generate the separation discharge when conveying the recording material 20 from the first guide member 120 to the second guide member 140. The present embodiment is configured to make the electrostatic capacity on the region variable between the first electrification adjuster 27 and the second electrification adjuster 28 while keeping the recording material 20 to be conveyed in contact with the intermediate guide member 130.

Function of Intermediate Guide Member

Figure 9:
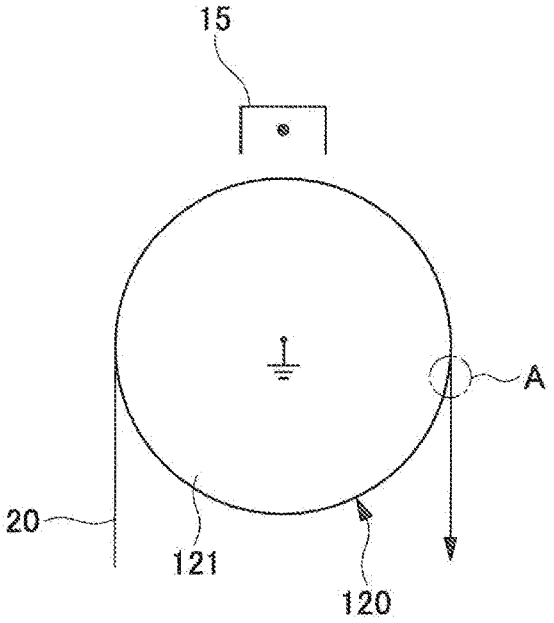
FIG. 9 is an explanatory view showing an example of a generally employed electrification adjustment apparatus.

A function of the intermediate guide member 130 will be described referring to FIGS. 9 and 10. FIG. 9 is an explanatory view showing an example of a generally employed electrification adjuster. Referring to FIG. 9, an electrification adjuster 15 supplies the charge with one polarity to the recording material 20 to be conveyed by the first guide member 120 as the conductive roller. The electrification adjuster 15 is a corona electrifier with no grid electrode. FIG. 10 is a graph showing results of calculating a gap potential difference with respect to a gap distance between the guide member and the recording material 20.

Referring to FIG. 9, upon separation of the recording material 20 from the first guide member 120 having its surface electrified, a gap (gap A) is formed between the first guide member 120 and the recording material 20. A gap potential difference of the gap is obtained for comparative purpose so as to explain how the intermediate guide member 130 functions. Furthermore, referring to FIG. 5, a gap potential difference at an inlet B of a nip part between the second guide member 140 and the intermediate guide member 130, and a gap potential difference at an outlet C of a nip part between the intermediate guide member 130 and the second guide member 140 are obtained.

FIG. 10 shows results of calculating each gap potential difference with respect to the gap distance, where the recording material 20 has the electrified charge density of 200 $\mu C/m^2$, the thickness of 10 μm, the specific dielectric constant of 2, and the insulation layer 142 on the surface of the second guide member 140 has the thickness of 100 μm, and the specific dielectric constant of 2. FIG. 10 also shows the calculation result of an approximate equation ($Vth=312+6.2d$ (d: gap distance, unit: μm)) for an insulation breakdown voltage Vth of an air layer in accordance with Paschen's law. Upon separation of the electrified recording material 20 from the first guide member 120, discharge occurred in the structure shown in FIG. 4 at the position around the region with the gap distance in excess of 10 μm. Compared with the above-described structure in FIG. 9, the structure as shown in FIG. 5 having the intermediate guide member 130 is capable of suppressing the gap potential difference to the low level as well as the separation discharge.

As described above, the second embodiment includes the first electrification adjuster 27 disposed at the upstream side of the direction for conveying the recording material 20, and the second electrification adjuster 28 disposed at the downstream side. The charge supplied by the first electrification adjuster 27 has an opposite polarity to that of the charge supplied by the second electrification adjuster 28. In the present embodiment, the electrostatic capacity between the surface (non-contact surface) of the recording material 20 in contact with the second guide member 140 and the electrode of the second guide member 140 is smaller than the electrostatic capacity between the surface (non-contact surface) of the recording material 20 in contact with the first guide member 120 and the electrode of the first guide member 120. In other words, the electrostatic capacity between the surface of the recording material 20 facing the second electrification adjuster 28 and the electrode of the second guide member 140 is smaller than the electrostatic capacity between the surface of the recording material 20 facing the first electrification adjuster 27 and the electrode of the first guide member 120.

In the above-described embodiment, as the electrostatic capacity at the side of the first electrification adjuster 27 is large, fluctuation in the potential on the surface of the recording material 20 (electrified potential) caused by the charge density non-uniformity is small, and the charge may be easily supplied to the recording material 20. It is therefore possible to reduce the electrification non-uniformity by electrifying the recording material 20 to one polarity in spite of the electrified potential non-uniformity on the recording material 20. Meanwhile, as the electrostatic capacity at the side of the second electrification adjuster 28 is small, the adjustment may be made to further reduce the charge density non-uniformity on the recording material 20 subjected to uniformization of the potential on the surface thereof.

The present embodiment employs the intermediate guide member 130 which allows either the front surface or the back surface of the recording material 20 to be in contact with the first guide member 120 or the second guide member 140 for the purpose of suppressing the separation discharge considered as a risk which may occur when switching the electrostatic capacity in the region covered between the first electrification adjuster 27 and the second electrification adjuster 28. This makes it possible to extend the upper limit of the charge amount supplied by the first electrification adjuster 27, as well as to eliminate larger electrification non-uniformity on the recording material 20.

Third Embodiment

In a third embodiment, another structure is described for obtaining the effect of the present invention by suppressing the separation discharge as an example in which arrangement of the second electrification adjuster 28 according to the second embodiment has been changed.

FIG. 11 is an explanatory view of an example of the electrification adjustment apparatus according to the third embodiment.

In the above-described second embodiment, the gap potential difference at the outlet C of the nip part formed between the intermediate guide member 130 and the second guide member 140 becomes large, which may cause the separation discharge. An electrification adjustment apparatus 30B as shown in FIG. 11 is configured to arrange a second electrification adjuster 28A to face the outlet C of the nip part between the intermediate guide member 130 and the second guide member 140.

The second electrification adjuster 28A is disposed near the outlet C of the nip part so as to intensify the electric field formed between the grid electrode 28*b* and the recording material 20 on the second guide member 140 positioned at the outlet C of the nip part. The charge may be supplied to the outlet C of the nip part between the intermediate guide member 130 and the second guide member 140, suppressing increase in the gap potential difference at the outlet C of the nip part. In this case, it is preferable not only to dispose the second electrification adjuster 28A to face the nip part between the second guide member 140 and the intermediate guide member 130, but also to dispose the grid electrode 28*b* proximally to the surface of the second guide member 140 from the perspective of appropriate charge supply to the recording material 20.

Fourth Embodiment

In a fourth embodiment, another structure is described for obtaining the effect of the present invention by suppressing the separation discharge as an example in which a voltage is applied to the intermediate guide member 130 according to the second embodiment.

Figure 12:
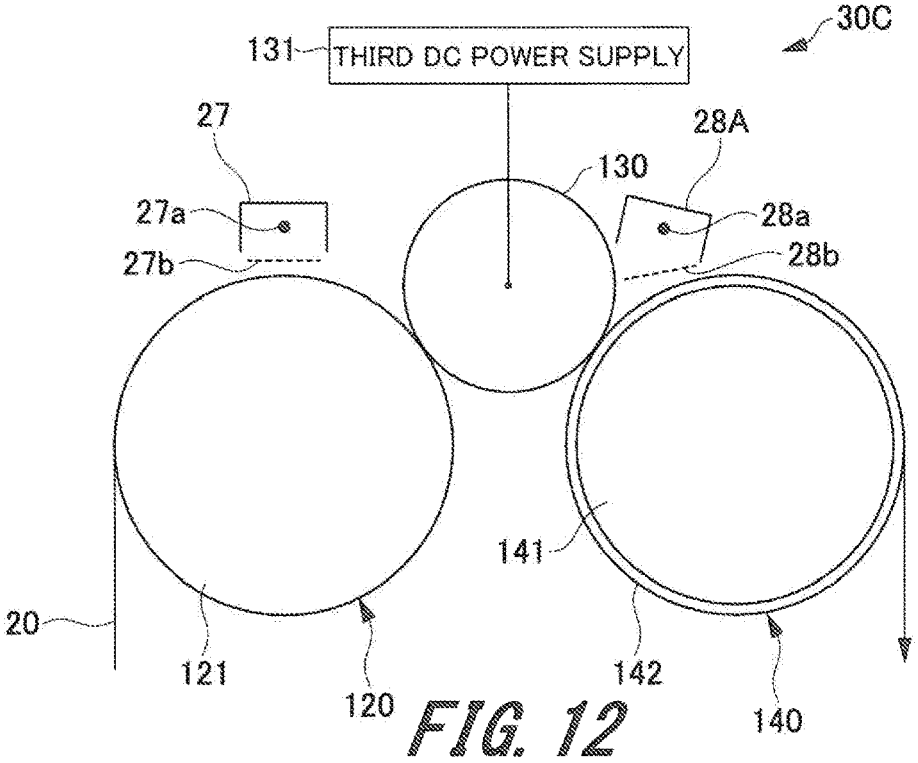
FIG. 12 is an explanatory view showing an example of an electrification adjustment apparatus according to a fourth embodiment of the present invention.

FIG. 12 is an explanatory view of an example of an electrification adjustment apparatus according to the fourth embodiment.

An electrification adjustment apparatus 30C as shown in FIG. 12 includes a third DC power supply 131 (power supply circuit) for applying the DC voltage with the same polarity as that of the charge supplied by the first electrification adjuster 27 to the intermediate guide member 130. As described above, the third DC power supply 131 applies the voltage with the same polarity as that of the charge supplied by the first electrification adjuster 27 to the intermediate guide member 130. As a result, increase in the gap potential difference may be slowed down, and the separation discharge may be prevented.

Fifth Embodiment

In a fifth embodiment, another structure is described for obtaining the effect of the present invention by suppressing the separation discharge as an example in which the first guide member 120 and the second guide member 140 according to the second embodiment have been integrally structured.

Figure 13:
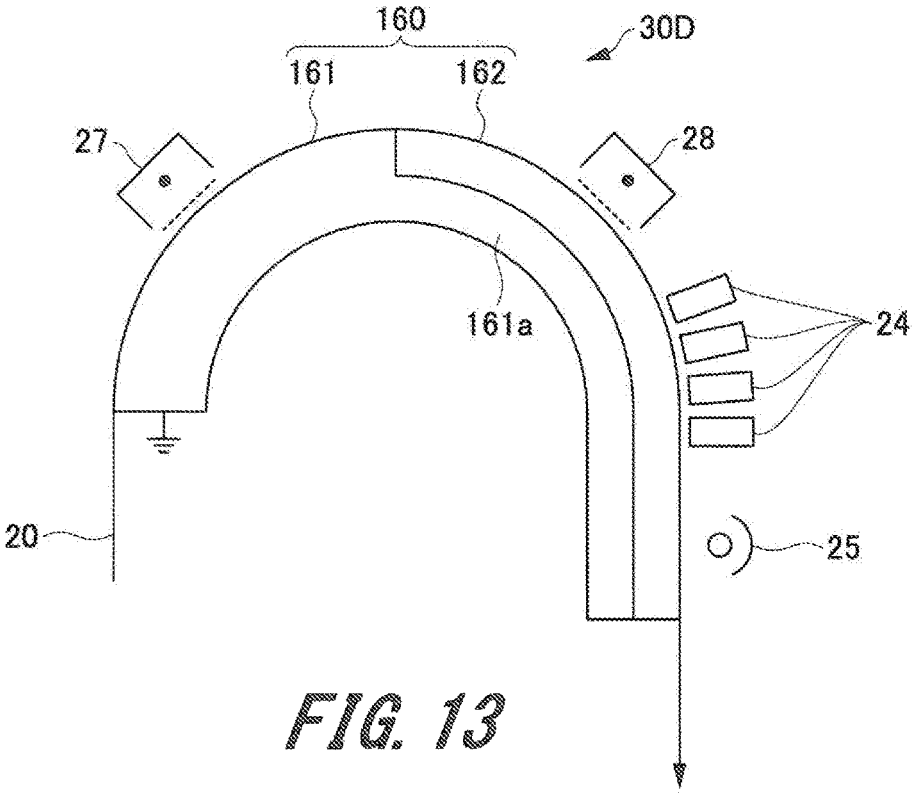
FIG. 13 is an explanatory view showing an example of an electrification adjustment apparatus according to a fifth embodiment of the present invention.

FIG. 13 is an explanatory view showing an example of an electrification adjustment apparatus according to the fifth embodiment.

An electrification adjustment apparatus 30D as shown in FIG. 13 includes a guide member 160 (an example of a conveyor member) formed by integrating a first guide 161 having a surface in contact with the recording material 20, which faces the first electrification adjuster 27, and a second guide 162 having a surface in contact with the recording material 20, which faces the second electrification adjuster 28 while being contiguous to each other. The guide member 160 on which the recording material 20 is wound has the function for guiding the recording material 20 while being conveyed.

The first guide 161 has a cylindrical shape (having an annular cross section (substantially semicircular shape in FIG. 13)) with a center axis in an orthogonal direction (main scanning direction) to the rotating direction of the recording material 20. A notch 161*a* with a depth corresponding to the thickness of the second guide 162 is formed from an arbitrary part (the highest point in FIG. 13) to the end at the downstream side on an outer circumferential surface of the first guide 161. The second guide 162 is formed in contact with the surface of the notch 161*a* of the first guide 161. Surfaces of the first guide 161 and the second guide 162, which are brought into contact with the recording material 20 form a single smooth contiguous surface with no stepped part.

For example, the first guide 161 is formed as a curved conductor (metal and the like), and the second guide 162 is formed as a curved insulating resin. In the present embodiment, the above-described structure and the selected material allow the electrostatic capacity at the second guide side to be smaller than the electrostatic capacity at the first guide side. The guide member 160 constituted by the first guide 161 and the second guide 162 is an example of the electrode constituted partially or entirely from the conveyor member.

As FIG. 13 shows, four head units 24 are disposed to face the second guide 162, and the fixing unit 25 is disposed at the downstream side of the head units 24.

In the case of the above-structured fifth embodiment, upon switching of the electrostatic capacity in the region covered between the first electrification adjuster 27 and the second electrification adjuster 28, the recording material 20 is conveyed while having its back surface in contact with the first guide 161 and the second guide 162 of the guide member 160. Therefore, the gap where the separation discharge occurs is not formed. This structure does not need the intermediate guide member 130, thus securing the compact electrification adjustment apparatus.

Measurement Result

An image was formed on the insulating recording material 20 by the ink-jet recording apparatus according to the respective embodiments using examples and comparative examples as described below. Confirmation results with respect to effects of the electrification adjustment will be described referring to FIG. 14. FIG. 14 is a table showing the respective measurement results derived from the first to the fifth examples, and the first and the second comparative examples.

First Example

The first example employed the ink-jet recording apparatus 200 (each of the electrification adjusters 27, 28 was a scorotron electrifier) as shown in FIG. 2.

Second Example

The second example employed the ink-jet recording apparatus 200A (each of the electrification adjusters 27, 28 was a scorotron electrifier) as shown in FIG. 6. A PET (polyethylene terephthalate) layer with thickness of 100 μm functioning as the insulation layer 142 was formed on the surface of the second guide member 140.

Third Example

The third example employed the ink-jet recording apparatus 200A (each of the electrification adjusters 27, 28 was a scorotron electrifier) as shown in FIG. 6. The PET (polyethylene terephthalate) layer with thickness of 100 μm functioning as the insulation layer 142 was formed on the surface of the second guide member 140. The voltage of −300 V was applied to the intermediate guide member 130.

Fourth Example

The fourth example employed the ink-jet recording apparatus 200A shown in FIG. 6, provided with the electrification adjustment apparatus 30B shown in FIG. 11 as the electrification adjustment apparatus (each of the electrification adjusters 27, 28 was a scorotron electrifier). The PET layer (insulation layer) with thickness of 100 μm was formed as the second guide 162 of the guide member 160 in the area covered by the electrification adjuster 28.

Fifth Example

The fifth example employed the ink-jet recording apparatus 200A shown in FIG. 6, provided with the electrification adjustment apparatus 30B shown in FIG. 13 as the electrification adjustment apparatus (each of the electrification adjusters 27, 28 was a scorotron electrifier). The PET layer (insulation layer) with thickness of 100 μm was formed as the second guide 162 of the guide member 160.

First Comparative Example

The first comparative example employed the ink-jet recording apparatus 200 shown in FIG. 2, from which the electrification adjustment apparatus 30 was removed.

Second Comparative Example

The second comparative example employed the ink-jet recording apparatus 200 shown in FIG. 2, having an ion generator disposed between the first guide member 120 and the driven roller 113 in place of the first electrification adjuster 27 and the second electrification adjuster 28.

Evaluations have been made using the recording material made of the PET with thickness of 12 μm (hereinafter referred to as "PET recording material"), and the recording material made of OPP (oriented polypropylene) with thickness of 30 μm (hereinafter referred to as "OPP recording material") for the recording material 20 subjected to the electrification adjustment, on which a half tone (isolated dot) image was output by the ink-jet recording apparatus. The electrification adjustment was performed for the respective structures of the examples and the comparative examples under conditions where the voltage with negative polarity (−7 kV) was applied to the corona discharge electrode 27*a* of the first electrification adjuster 27, the grid voltage was set to −50 V, −100 V, −150 V, −300V, the voltage with positive polarity (7 kV) was applied to the corona discharge electrode 28*a* of the second electrification adjuster 28, and the grid voltage was set to 0 V, −100 V.

The uniformity of the output image was visually evaluated. If the image has uniformity (no image non-uniformity), the mark "0" was recorded. If the image has slight non-uniformity, the mark "A" was recorded. If the image has much non-uniformity, the mark "x" was recorded. The ink adhesion state to the ink-jet head 242 after outputting the image was observed. If the ink adhesion was hardly observed, the mark "0" was recorded. If the ink adhesion was slightly observed, the mark "A" was recorded. If much ink adhesion was observed, the mark "x" was recorded.

The table of FIG. 14 shows measurement results derived from the first to the fifth examples, and the first and the second comparative examples. As the table shows, the image non-uniformity with irregular outline (recorded as "x" indicating lack of image uniformity) was observed in the first and the second comparative examples. Those comparative examples failed to eliminate the image non-uniformity. Meanwhile, under the conditions where the PET recording material with thickness of 12 μm was used, and the grid voltage of the first electrification adjuster 27 was set to the appropriate value (−100V or higher), effects of the examples for eliminating the image non-uniformity were observed. Observing the enlarged part of the outlined image with non-uniformity as described above, disorder of the dot shape, that is, elliptical shape was confirmed.

The measurement results derived from the first to the fifth examples will be verified in detail.

As for the structure of the first example under the conditions where the PET recording material with thickness of 12 μm was used, and the grid voltage of the first electrification adjuster 27 was −100 V, the effect for eliminating the image non-uniformity was insufficient compared with other examples, indicating the need of increasing the grid voltage to −150 V. The result reflects the difference in the electrostatic capacity of the guide member (counter member) in the area covered by the second electrification adjuster 28. In the structure according to the first example, the electrostatic capacity in the area covered by the second electrification adjuster 28 is large to apparently reduce the potential non-uniformity caused by the charge density non-uniformity. Therefore, the resultant effect for eliminating the image non-uniformity is considered to be low.

As for the structure of the second example, generation of the image non-uniformity was observed when the grid voltage of the first electrification adjuster 27 was high (−150 V in the case of the PET recording material with thickness of 12 μm) in comparison with other examples. The image non-uniformity is considered to have been caused by the separation discharge upon switching of the electrostatic capacity between the first electrification adjuster 27 and the second electrification adjuster 28.

As for the structures of the third to the fifth examples, the advantageous effect for eliminating the image non-uniformity was confirmed.

Focusing on the stain of the ink-jet head 242, it has been confirmed that the characteristic of the stain was determined by the grid voltage of the second electrification adjuster 28 when using the OPP recording material with thickness of 30 μm. Specifically, the advantageous effect was derived from the ink-jet recording apparatus according to the first to the fifth examples under the conditions where the OPP recording material with thickness of 30 μm was used, and the grid voltage of the second electrification adjuster 28 was set to −100 V. It was also confirmed that the effect for eliminating the stain of the ink-jet head 242 was derived from the use of the PET recording material with thickness of 12 μm under the condition where the grid voltage of the second electrification adjuster 28 was set to −100 V.

The measurement results validate that the respective examples of the embodiments according to the present invention suppress electrification non-uniformity on the surface of the recording material so as to allow elimination of the image noise owing to the electrification non-uniformity. In other words, the examples of the respective embodiments according to the present invention are capable of improving the image quality.

Effects of Embodiments

The above-described first to the fifth embodiments allow sufficient suppression of not only the apparent electrified potential non-uniformity owing to the charge density non-uniformity of the recording material such as the resin film but also the charge density non-uniformity. Accordingly, this makes it possible to suppress unnecessary influence of the electric field as a result of the electrification non-uniformity in the image forming processing for adhering the pigment (ink droplet) to the recording material. For example, in the ink-jet type image forming processing, it is possible to appropriately control flying of the ink droplet by eliminating the electrification non-uniformity of the recording material which may influence the flying of the ink droplet, and the shape of the landed droplet. It is therefore possible to suppress the unnecessary influence of the electric field upon flying of the ink droplet, and further suppress the dot deformation accompanied with the electrostatic induction of the droplet landed on the recording material.

The present invention is not limited to the above-described embodiments, but may be arbitrarily applied and modified in various forms so long as they do not deviate from the scope of the present invention.

For example, the embodiments have been described in detail for readily understanding of the present invention with respect to structures of the apparatus and the system, which are not necessarily limited to the one equipped with all components as described above. It is possible to replace a part of the structure of one embodiment with the component of another embodiment. The one embodiment may be provided with an additional component of another embodiment. It is further possible to add, remove, and replace the other component to, from and with a part of the structure of the respective embodiments.

It is also possible to implement the respective components, functions and processing units partially or entirely through hardware by designing integrated circuits, for example.

REFERENCE SIGNS LIST

20 . . . recording material, 27 . . . first electrification adjuster, 28 . . . second electrification adjuster, 30,30A,30B, 30C,30D . . . electrification adjustment apparatus, 120 . . . first guide member, 121 . . . metal roller, 130 . . . intermediate guide member, 131 . . . third DC power supply, 140 . . . second guide member, 141 . . . metal roller, 142 . . . insulation layer, 160 . . . guide member, 161 . . . first guide, 162 . . . second guide, 200,200A . . . ink-jet recording apparatus, 271 . . . first DC power supply, 281 . . . second DC power supply

What is claimed is:

1. An ink-jet recording apparatus comprising:

an electrification adjustment apparatus for adjusting electrification of a recording material to be conveyed; and an image forming unit for forming an image on the recording material which has been subjected to an electrification adjustment through ink-jet processing, wherein:

the electrification adjustment apparatus includes a conveyor member for conveying the recording material;

a first electrification adjuster disposed to face the recording material to be conveyed, the first electrification adjuster supplying a charge with one polarity;

a second electrification adjuster disposed at a downstream side of the first electrification adjuster in a conveying direction while facing the recording material, the second electrification adjuster supplying a charge with opposite polarity to the one polarity of the charge supplied by the first electrification adjuster;

a first DC power supply for DC power supply to the first electrification adjuster; and a second DC power supply for DC power supply to the second electrification adjuster, the second DC power supply having a polarity opposite to the polarity of the first DC power supply.

2. The ink-jet recording apparatus according to claim 1, wherein an electrostatic capacity between a surface of the recording material, which faces the second electrification adjuster and an electrode partially or entirely formed from the conveyor member is smaller than an electrostatic capacity between the surface of the recording material, which faces the first electrification adjuster and the electrode partially or entirely formed from the conveyor member, and any one of the surface and a back surface of the recording material is in contact with the conveyor member in a region between the first electrification adjuster and the second electrification adjuster.

3. The ink-jet recording apparatus according to claim 2, wherein:

the conveyor member includes a first guide member having a surface in contact with the recording material, a second guide member which is disposed at a downstream side of the first guide member in the conveying direction, and has a surface in contact with the recording material, and an intermediate guide member which is disposed in abutment with both the first guide member and the second guide member; and an electrostatic capacity on the surface of the second guide member is smaller than an electrostatic capacity on the surface of the first guide member.

4. The ink-jet recording apparatus according to claim 3, wherein the second electrification adjuster is disposed to face a nip part between the second guide member and the intermediate guide member.

5. The ink-jet recording apparatus according to claim 3, further comprising a third DC power supply for applying a voltage to the intermediate guide member, the voltage having the same polarity as the polarity of the charge supplied by the first electrification adjuster.

6. The ink-jet recording apparatus according to claim 3, wherein:

each of the first guide member, the second guide member, and the intermediate guide member has a conductive roller; and an insulation layer is coated on a circumferential surface of the roller of the second guide member.

7. The ink-jet recording apparatus according to claim 1, wherein:

the conveyor member is structured to allow a first guide which faces the first electrification adjuster, and has a surface in contact with the recording material, and a second guide which faces the second electrification adjuster, and has a surface in contact with the recording material to be formed contiguous to each other; and an electrostatic capacity of the second guide is smaller than an electrostatic capacity of the first guide.

8. The ink-jet recording apparatus according to claim 1, wherein the image forming unit is disposed near a surface of a member on which the recording material is wound while facing the second electrification adjuster at a downstream side of the second electrification adjuster so that the image is formed on the member by the image forming unit.

9. The ink-jet recording apparatus according to claim 1, wherein:

each of the first electrification adjuster and the second electrification adjuster includes a discharge electrode, and a grid electrode disposed between the discharge electrode and the recording material; and a charge amount to be supplied to the recording material is adjusted in accordance with a voltage applied to the grid electrode.

10. The ink-jet recording apparatus according to claim 1, wherein an electrified potential of the recording material is adjusted by the second electrification adjuster in accordance with an electrification polarity of an ink droplet discharged from a nozzle of the image forming unit.

* * * * *